US006957646B2

(12) United States Patent
Nibecker, Jr.

(10) Patent No.: US 6,957,646 B2
(45) Date of Patent: Oct. 25, 2005

(54) PUMP

(76) Inventor: Alfred F. Nibecker, Jr., 935 Riverside, Unit 19, Paso Robles, CA (US) 93446

( * ) Notice: Subject to any disclaimer, the term of this patent is extended or adjusted under 35 U.S.C. 154(b) by 0 days.

(21) Appl. No.: 10/774,171

(22) Filed: Feb. 6, 2004

(65) Prior Publication Data

US 2004/0154599 A1 Aug. 12, 2004

Related U.S. Application Data

(62) Division of application No. 10/427,637, filed on Apr. 30, 2003, now Pat. No. 6,701,908, which is a division of application No. 09/990,908, filed on Nov. 16, 2001, now Pat. No. 6,581,585.

(51) Int. Cl.[7] ..... F41B 11/00
(52) U.S. Cl. ..... 124/65; 417/464
(58) Field of Search ..... 417/460, 464; 124/56, 63, 64, 65, 69, 70, 73, 75

(56) References Cited

U.S. PATENT DOCUMENTS

| | | | | |
|---|---|---|---|---|
| 510,036 | A | * 12/1893 | Lowth | 280/201 |
| 1,292,665 | A | 1/1919 | Udesen | |
| 1,486,215 | A | 3/1924 | Zerbee | |
| 1,831,379 | A | * 11/1931 | Creser | 417/63 |
| 2,119,441 | A | 5/1938 | Price | |
| 2,145,277 | A | 1/1939 | Reardon | |
| 2,652,821 | A | 9/1953 | Fitch | |
| 2,781,166 | A | * 2/1957 | Flood et al. | 417/464 |
| 4,242,060 | A | * 12/1980 | Price | 417/464 |
| 4,304,213 | A | 12/1981 | Jereckos | |

(Continued)

FOREIGN PATENT DOCUMENTS

DE 4419680 C1 8/1995

FR 2633709 A1 1/1990

OTHER PUBLICATIONS

Internet papers: B. Saltzman, "Three Basic Types of Airguns", Beeman Precision Airguns, http://beeman.com/types.htm, four pages, retrieved on Jul. 11, 2001.

*Primary Examiner*—Harvey E. Behfiend
*Assistant Examiner*—Jordan Lofdahl
(74) *Attorney, Agent, or Firm*—Christie, Parker & Hale, LLP

(57) ABSTRACT

An air gun includes an air pump with a pumping piston mounted to reciprocate within a pump cylinder, which is mounted on the barrel of the gun to pivot about an axis transverse to the longitudinal axis of the barrel so that as the pump cylinder is moved back and forth around the pivot, the cylinder and piston reciprocate relative to each other to pump air into a high pressure housing carried by the pump cylinder. A discharge conduit is also provided for releasably connecting the high pressure housing to the breach end of a gun barrel when the pump is moved toward the barrel. A firing valve in the discharge conduit releases air from the high pressure housing into the breach end of the barrel. Preferably, a floating differential piston disposed to reciprocate in a high pressure housing divides the housing into a storage chamber and a high pressure chamber. A pressure relief valve extending through the differential piston permits compressed air to flow from the storage chamber to the firing chamber, and maintains a higher pressure in the storage chamber than in the firing chamber. The end of the piston in the firing chamber seals a greater cross sectional area than the end of the piston in the storage chamber so that a piston is forced to move into the storage chamber by an amount which balances the forces on the opposite end of the piston. The gun barrel muzzle includes at least one lateral opening for venting compressed air as a pellet leaves the muzzle end of the barrel.

1 Claim, 17 Drawing Sheets

U.S. PATENT DOCUMENTS 4,472,794 A 9/1984 Chelminski
4,572,152 A 2/1986 Olofsson et al.
4,709,686 A 12/1987 Taylor et al.
4,771,758 A 9/1988 Taylor et al.
4,844,046 A 7/1989 Straub
4,850,329 A 7/1989 Taylor et al.
4,928,661 A 5/1990 Bordt et al.
5,118,265 A * 6/1992 Bearss ..... 417/534
5,193,517 A 3/1993 Taylor et al.
5,224,465 A 7/1993 Milliman
5,341,790 A 8/1994 Ebert
5,538,398 A * 7/1996 Elson ..... 417/53
5,617,837 A 4/1997 Momirov
5,798,474 A 8/1998 Rogers et al.
5,813,392 A 9/1998 McCaslin
6,343,598 B1 2/2002 Pshenychny

* cited by examiner

PUMP

CROSS-REFERENCE TO RELATED APPLICATION(S)

This application is a divisional application of U.S. patent application Ser. No. 10/427,637, filed Apr. 30, 2003 now U.S. Pat. No. 6,701,908 which is a divisional application of U.S. patent application Ser. No. 09/990,908, filed Nov. 16, 2001, now U.S. Pat. No. 6,581,585, the disclosures of which are incorporated herein by reference.

BACKGROUND OF THE INVENTION

This invention relates to pumps which can supply a charge of compressed gas on demand, such as for guns which use a charge of compressed air to fire a pellet.

Air guns have a wide following because laws limiting their use are not as restrictive as for powder guns, and air guns are relatively inexpensive to shoot. Air gun shooting is an Olympic sport, and hunting with an air gun removes much of the danger inherent with powder guns while retaining and enhancing the challenge.

Air guns fall into three major groups:

1. Pump guns: These guns use one or more strokes from a pumping device to store a charge of compressed air in a firing chamber. The required effort to charge the gun increases with each pump as the stored pressure builds. The power of the gun depends on the strength of the shooter because the relatively low mechanical advantage of the pumping mechanism. Most of these guns completely expel the air charge when fired. On firing, the pellet is initially exposed to the full pressure of the compressed air, but the available pressure falls rapidly as the pellet accelerates down the gun barrel. These guns usually have moderate power, driving a pellet at about 500 feet per second. U.S. Pat. No. 4,572,152 to Olofsson, et al., discloses an air gun which uses a floating piston to store compressed air in an auxiliary chamber. The purpose of the floating piston is to augment firing pressure by moving to displace air in the firing chamber when the gun is fired. However, with the gun disclosed in the Olofsson, et al. patent, the compressed air stored in the auxiliary chamber is limited to that provided by one stroke of the pump, and the pressure in the auxiliary chamber can never be greater than the pressure in the firing chamber.

2. Spring guns: These guns use a single stroke of a lever to compress a steel spring. On firing, the spring drives a relatively heavy piston that causes a rapid increase in air pressure within a firing chamber. The firing chamber is directly connected to the gun barrel. The pellet is held in the gun barrel by a seal until the air pressure in the chamber reaches an optimum point. When this happens, the air pressure overcomes the holding ability of the seal and drives the pellet down the barrel. The piston also continues to displace air in the firing chamber, thereby helping to maintain pressure on the pellet. This method has replaced multi-stroke pumping as the most common air gun mechanism. Only one stroke of the lever accomplishes the entire cocking procedure. Thus, a spring gun usually takes less time to place into action than a multi-stroke gun. By maintaining a more constant force on the pellet as it travels down the barrel, the imparted energy may be twice that available with a conventional pneumatic multi-pump gun. However, the drawback of a spring gun is that only one stroke of the lever is available to compress the spring. The most powerful spring guns require strength beyond the limit of many people. Moreover, the spring imposes a practical limit on the amount of energy that can be stored. At least one model has replaced the steel spring with a compressed air "spring." The compressed air in the "spring" is not expended but is re-compressed with the gun's lever. The air spring can store more energy in a smaller space, but considerable work must be expended by the shooter.

3. Pre-charged guns: These guns use a gas charge that is pre-packaged and inserted into the gun with little expenditure of energy by the user. The most common guns of this type use a small container of liquid carbon dioxide to power the gun. Each firing of the gun uses a portion of the stored liquid, which rapidly vaporizes on firing. A method gaining popularity transfers compressed air from a storage bottle into a relatively large storage vessel attached to the gun. For example, air from a diver's scuba tank or similar storage vessel is transferred into the storage vessel on the gun through a high-pressure hose and clamp assembly. The gun gets multiple shots from charges provided by the air in the storage vessel, but the accuracy of the gun diminishes with the loss of available pressure until the storage vessel is refilled. Some carbon dioxide ($CO_2$) guns use small canisters available at hardware stores. These guns are moderately powerful, but also suffer from accuracy problems with the loss of pressure in the canister. Guns which use compressed air from large detached tanks can store more energy and suffer less in accuracy lost between shots. However, the detached tank (such as a scuba tank) is heavy and cumbersome.

In summary, multiple-pump air guns are limited by the strength of the user, and the initial strokes are time consuming for the amount of useful energy transferred to the storage chamber. Spring guns use one quick pull of a lever and achieve efficiency with the available energy, but are limited by the strength of the individual loading the gun. Guns which use a pre-charged vessel of compressed gas must have the vessel in close proximity to the gun, and cannot rely on precision repeat performance with each shot.

Maximum muzzle energy for the three types of guns is about 11.5 foot-pounds for the best multi-pump guns, about 25 foot-pounds for the best spring guns, and about 30 foot-pounds for the best pre-charged gun using air from a scuba tank.

Convenient power is the goal of air guns. With more power the pellet trajectory is flatter, accuracy is enhanced, and more energy is delivered at the point of impact.

SUMMARY OF THE INVENTION

This invention provides an air gun which stores and imparts increased shooting power without requiring the shooter to be of more than average strength. The gun uses a unique pumping action with a large mechanical advantage to store energy and efficiently transfer stored energy to the pellet to achieve muzzle energy in excess of 40 foot-pounds.

The air gun of this invention uses an improved air pump which includes a pump cylinder and a pump piston mounted to reciprocate within the cylinder. The pump cylinder and a piston rod connected to the piston are each connected to the barrel of the gun to pivot about separate respective longitudinally spaced axes, which are transverse to the longitudinal axis of the barrel. As the pump cylinder and piston rod are moved back and forth around their respective the pivot points, the cylinder and piston reciprocate relative to each other to pump air into an inlet of a high pressure housing carried by the pump cylinder. A firing conduit connected to the high pressure housing releasably connects an outlet of the high pressure housing to the breech end of a gun barrel when the pump cylinder is moved to be parallel with the barrel. A trigger-responsive firing valve in the firing conduit releases air from the high pressure housing into the breech end of the barrel to fire a pellet from the gun. In a preferred embodiment, the piston rod is secured at one end to the piston, and at the other end to a first pivot point on the gun barrel. An elongated drive link is secured at one end to a pivot point on the cylinder, and at the other end to a second pivot point on the gun barrel, so that as the cylinder and piston are moved back and forth about the first and second pivot points, the piston reciprocates in the cylinder to force air through a check valve and into the high pressure housing. The length of the drive link and the longitudinal spacing between the first and second pivot points are set so when the pump cylinder is moved to be substantially parallel to the barrel, the piston contacts the check valve which admits air into the high pressure housing so a maximum amount of compressed air is transferred to the high pressure housing with each compression stroke of the pump. The first pivot point is located to the rear of the second pivot point and is spaced slightly farther from the longitudinal axis of the gun barrel so when the pump cylinder is moved toward the gun barrel to a "dead center" position, which places the longitudinal axis of the piston rod and piston substantially in alignment with the first and second pivot points, the piston contacts the check valve with maximum force. At this point, the pump cylinder extends rearwardly and away from the gun barrel to leave ample space for gripping the rear end of the cylinder to actuate the pump. Further movement of the pump cylinder toward the gun barrel carries the piston rod and piston slightly past the "dead center" position. The elasticity inherent in the gun and pump components accommodates movement of the pump cylinder back and forth through the "dead center" position, which acts as a moderate detent to hold the pump cylinder snugly against the barrel when the gun is to be prepared for firing.

In a further preferred embodiment of the invention, a floating differential piston is disposed to move longitudinally within the high pressure housing and divide the housing into a storage chamber adjacent the housing inlet and a firing or discharge chamber adjacent the housing outlet. A pressure relief valve in a pressure relief conduit extending through the floating differential piston from the storage chamber to the firing chamber maintains a higher pressure in the storage chamber than in the firing chamber. Preferably, the pressure relief valve is adjustable. The diameter of the end of the floating differential piston adjacent the storage chamber is smaller than the diameter of the end of the piston adjacent the firing chamber. A first sliding seal is provided between the interior of the high pressure housing and the smaller end of the piston. A second sliding seal between the housing interior and the larger end of the piston seals a larger cross-sectional area of the housing than the first seal. When air pressure in the storage chamber exceeds the differential pressure set by the pressure relief valve in the pressure relief conduit, air flows through the conduit from the storage chamber and into the firing chamber until the pressure in the firing chamber reaches a value which permits the pressure relief valve to close. As the pressure in the two chambers increases, the larger cross-sectional area of the firing chamber sealed by the larger end of the floating differential piston causes the piston to move toward the inlet end of the housing, thereby reducing the volume of air in the storage chamber and increasing the volume of air stored in the firing chamber until the forces acting on each end of the piston are balanced. Additional pumping stores more compressed air in the storage and firing chambers until the desired firing pressure is reached. When the firing valve in the housing outlet releases compressed air from the firing chamber in response to pulling the trigger on the gun, compressed air in the storage chamber expands and drives the floating differential piston toward the housing outlet as compressed air in the firing chamber enters the barrel breech to drive a pellet out the barrel. Thus the compressed air in the storage chamber expands and drives the floating differential piston toward the outlet of the firing chamber to maintain a more uniform pressure on the pellet as it is fired. The pressure relief valve in the floating piston tends to open momentarily when the firing of the gun suddenly drops the pressure in the firing chamber. However, loss of compressed air from the storage chamber is minimized because the flow path for air from the storage chamber to the firing chamber is so restricted, that only a small amount of air is lost from the storage chamber before the pressure relief valve closes. The lost air is quickly replaced when the pump is operated for the next shot. Preferably, the mass of the floating differential piston is as low as practical, and a mechanical compression spring also urges the floating piston toward the firing valve to further minimize loss of air from the storage chamber when the gun is fired.

The gun of this invention supplies such a large mass of high-velocity compressed air behind the pellet as the pellet leaves the barrel, there is a tendency for the air to overrun the pellet and cause it to precess or tumble, which would destroy accuracy. To avoid this problem, the muzzle end of the rifle barrel includes at least one lateral opening through the barrel to vent some air under pressure before the pellet leaves the barrel.

BRIEF DESCRIPTION OF THE DRAWINGS

The invention will be more fully understood from the following detailed description taken in conjunction with the accompanying drawings, in which:

FIG. 4G is an exploded view of some elements which fit in the forward end of the pump shown in FIG. 4;

DESCRIPTION OF SPECIFIC EMBODIMENT

Figure 1:
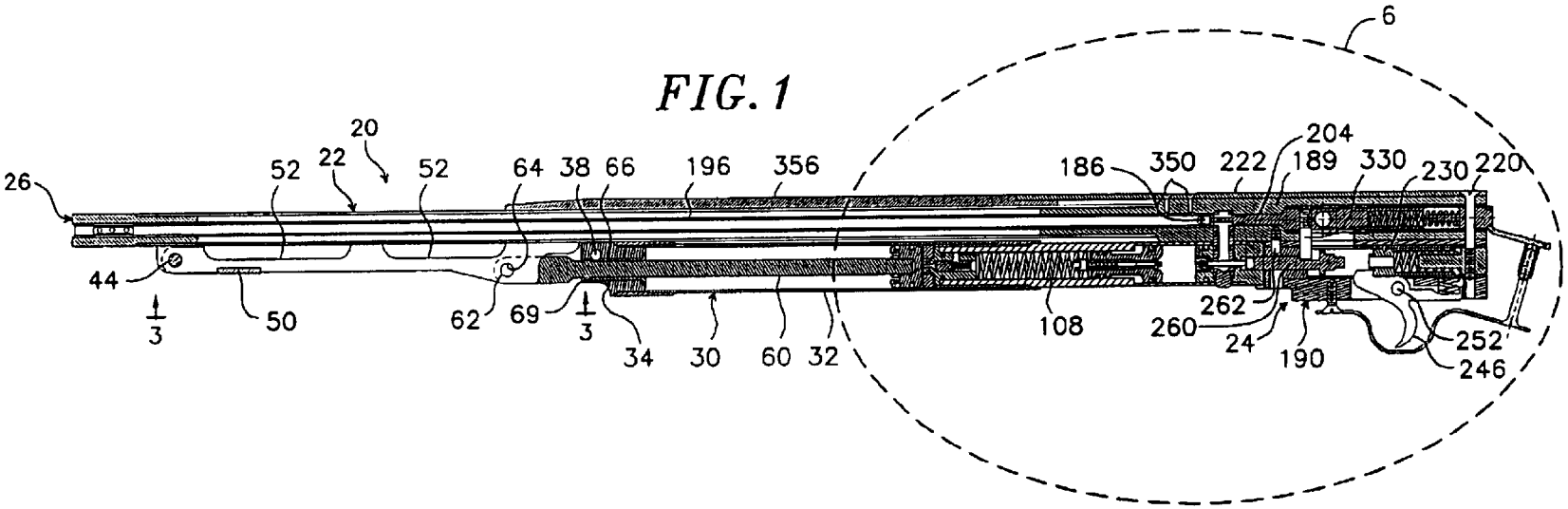
FIG. 1 is a longitudinal section of the gun in firing position.
Figure 2:
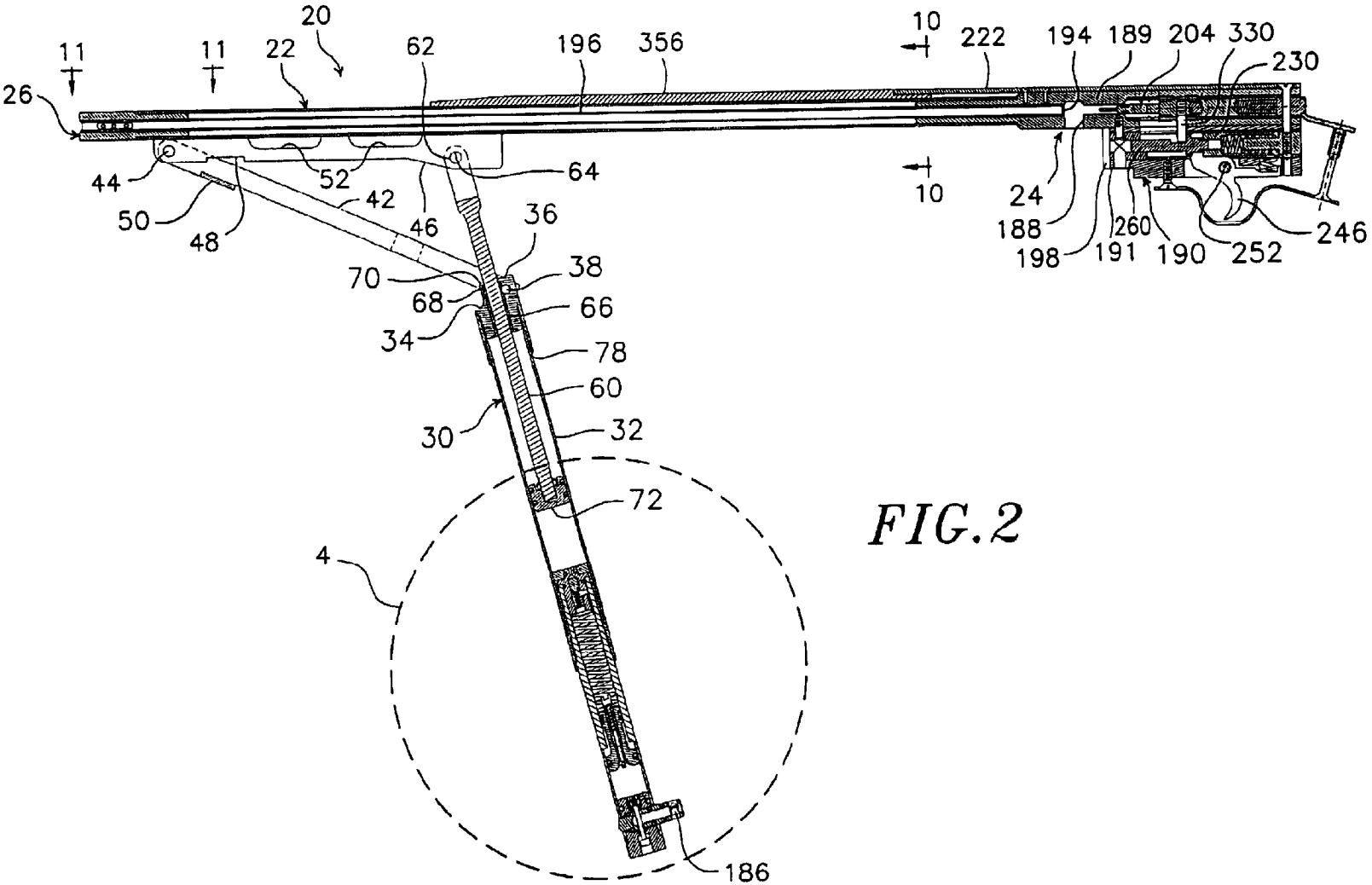
FIG. 2 is a longitudinal section of the gun in loading position, and with the pump cylinder pulled away from the barrel to actuate the pump.
Figure 3:
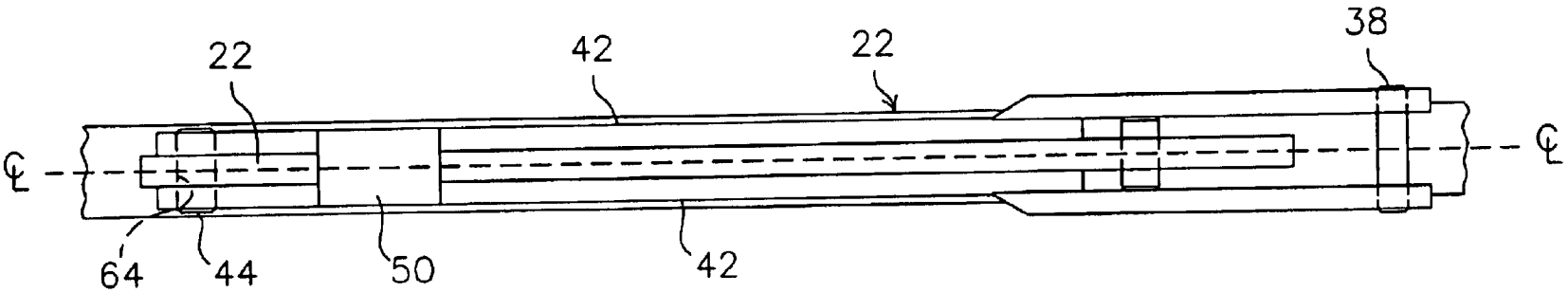
FIG. 3 is a fragmentary view taken on line 3—3 of FIG. 1 showing the linkage for activating the pump.
Figure 4:
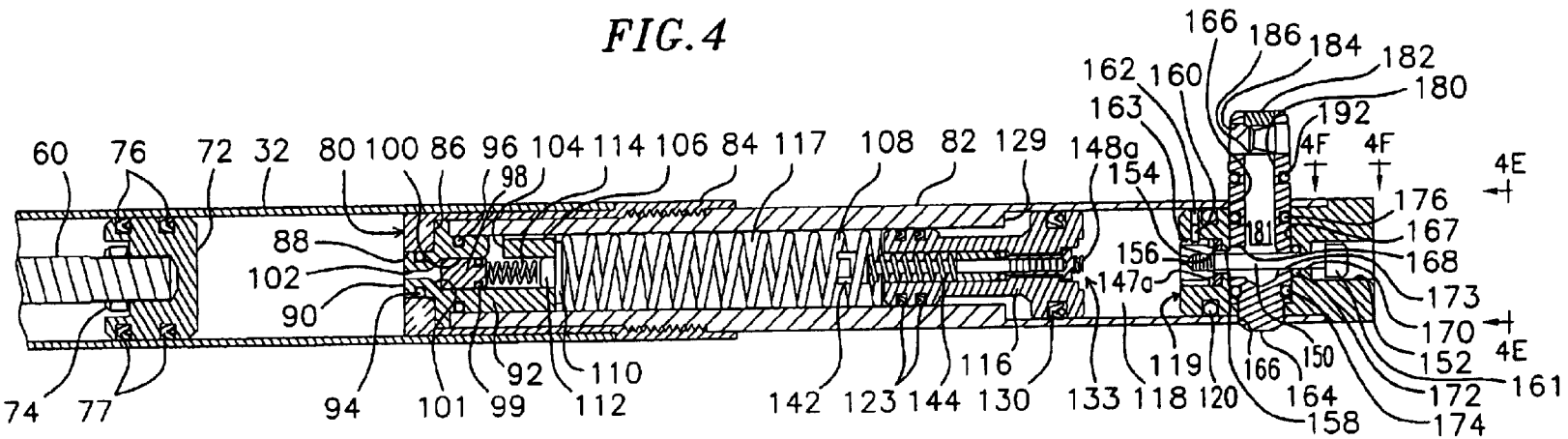
FIG. 4 is an enlarged fragmentary view of the pump and high pressure housing taken in the area of 4—4 of FIG. 2.
Figure 4A:
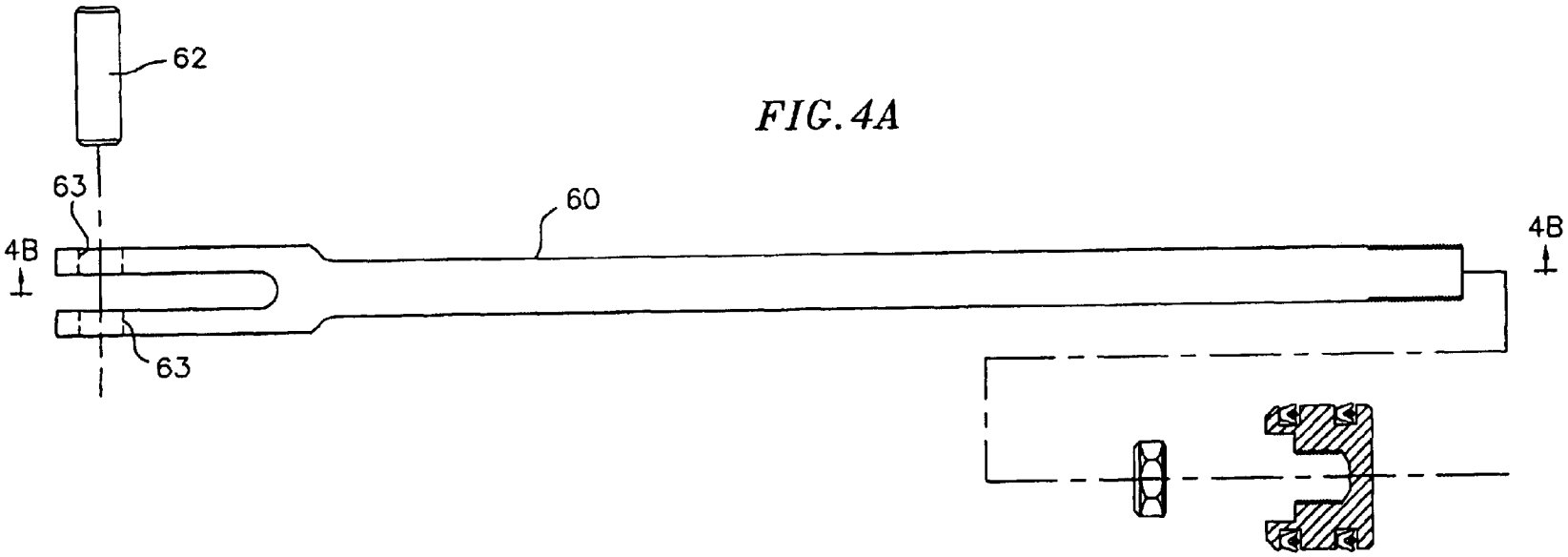
FIG. 4A is an exploded elevation, partly in section, of the pump piston and rod used in the pump.
Figure 4B:
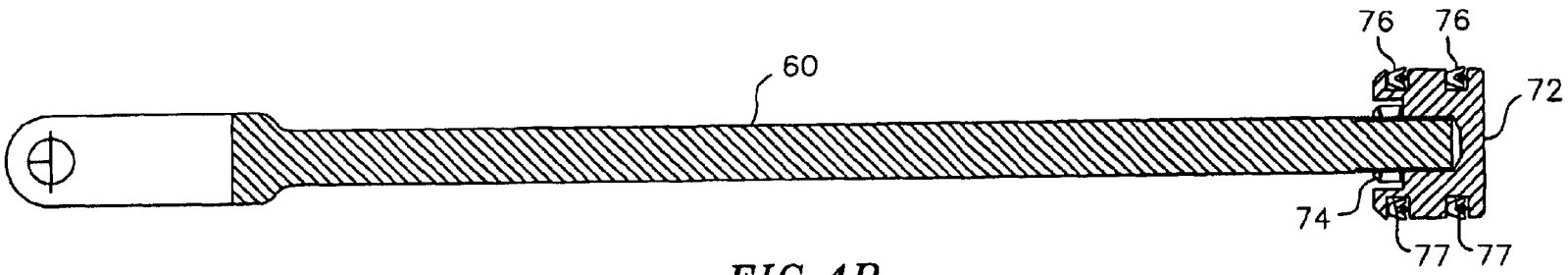
FIG. 4B is a view taken on line 4B—4B of FIG. A showing the pumping piston secured to the piston rod.
Figure 4C:
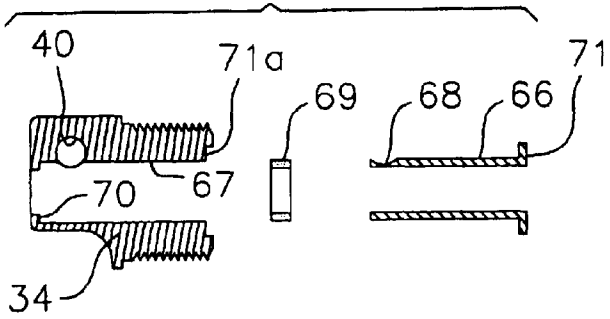
FIG. 4C is a longitudinal section of the pumping cylinder partially assembled.
Figure 4D:
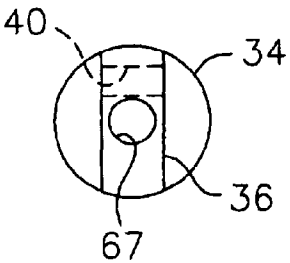
FIG. 4D is a view taken on line 4D—4D of FIG. 4C.
Figure 4C:
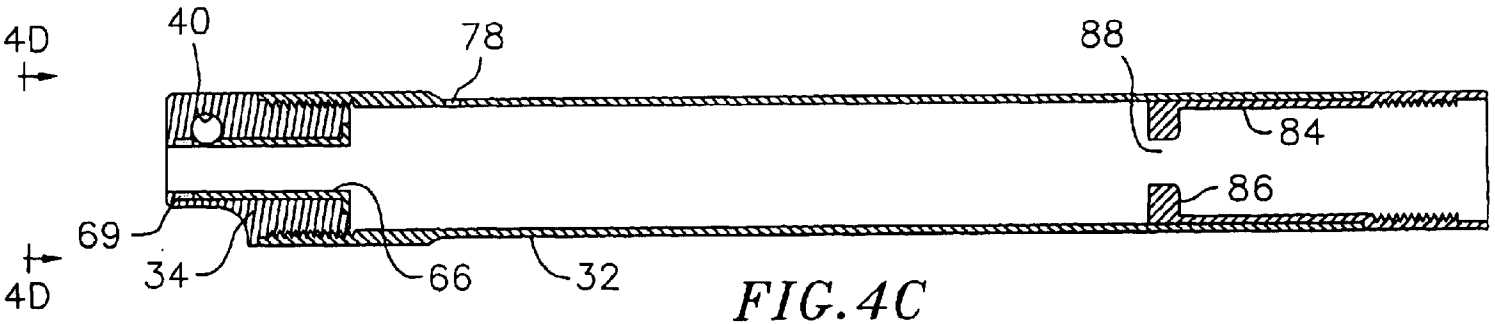

Referring to FIGS. 1 and 2, an air gun 20 includes an elongated barrel 22 having a breech end 24, and a muzzle end 26. A pump 30 includes an elongated pump cylinder 32 adjacent and parallel to the underside of the gun barrel when the gun is in the firing position shown in FIG. 1. An externally threaded plug 34 threaded into the forward end of the pump cylinder includes a forwardly extending ear 36 (FIG. 4D). A plug pivot pin 38 extends through a transverse bore 40 (FIG. 4C) offset from the longitudinal center line of the plug to secure the plug and forward end of the cylinder between the rear ends of a pair of identical elongated and laterally spaced longitudinally extending drive links 42 (FIG. 3) secured at their forward ends by a transverse pivot pin 44 to the forward end of an elongated and longitudinally extending barrel-stiffening web 46 welded at its upper edge to the underside of the forward end of the gun barrel. A downwardly opening notch 48 (FIG. 2) in the lower edge of the forward portion of the web receives a transverse reinforcing plate 50 welded across the bottom edges of the forward portions of the links 42 when the pumping cylinder is moved to the firing position shown in FIG. 1. A pair of longitudinally spaced and upwardly opening notches 52 in the upper edge of the web 46 reduce the weight carried by the gun.

The forward end of a piston rod 60 is forked (FIG. 4A) to fit on opposite sides of the rear end of the web, and is secured to the rear end of the web by a transverse pivot pin 62 extending through collinear bores 63 in the forked end of the piston rod and a collinear bore 64 (FIG. 3) of the web. Pivot pin 62 is slightly farther from the longitudinal axis of the gun than is pivot pin 44 for the forward end of the drive links 42 so that when the longitudinal axis of the piston rod is collinear with the pivot pins 44 and 62, the pump cylinder extends rearwardly and away from the gun barrel at an angle of about 3°. This facilitates gripping the cylinder to actuate the pump through a full pumping cycle, as described below.

The piston rod makes a close sliding fit through a bronze sleeve 66 which makes a snug fit in a central longitudinal bore 67 (FIG. 4G) extending through the plug 36 at the forward end of the pump cylinder. The sleeve is locked in place by plug pivot pin 38, the inner surface of which fits in a matching outwardly opening transverse semi-cylindrical recess 68 in the forward end of the sleeve (FIGS. 4C and 4G). A fiber washer 69 makes a sliding seal around the piston rod at the forward end of the bearing sleeve 66, which holds the washer against the inner surface of an inwardly extending annular shoulder 70 at the forward end of the plug 34. An outwardly extending annular flange 71 on the inner end of the sleeve makes a snug fit against a rearwardly facing annular shoulder 71*a* at the rear end of the plug 34 to insure proper longitudinal alignment of the sleeve recess 68 with transverse bore 40 before plug pivot pin 38 is driven into place, and to insure proper compression of fiber washer 69.

The rear end of the piston rod is threaded into the forward face of a pump piston 72. A lock nut 74 threaded around the rear end of the piston rod bears against the forward face of the pump piston, and locks the piston in a fixed position on the rod. A pair of longitudinally spaced U-cup seals 76 are each disposed in a respective outwardly opening annular groove 77 around the pumping piston to make a sliding seal against the interior of pump cylinder 32. The seals 76 are set to let air flow rearwardly past the piston, and prevent flow in the opposite direction.

When the pump cylinder and piston rod are pivoted clockwise (as viewed in FIG. 1) about pivot pin 62 from the firing position shown in FIG. 1 through an angle of about 100°, the drive links 42 pivot about pin 44, and force the cylinder to slide on the rod and piston away from the gun until the rear face of plug 34 contacts the forward face of the piston. The rear face of the piston is then forward of an air inlet hole 78 (FIG. 2) extending through the wall of the pump cylinder at the forward end of the pump. When the pump cylinder is moved back toward the firing position shown in FIG. 1, the pump piston moves rearwardly with respect to the pump cylinder until the rear face of the pump piston contacts the forward face of a check valve 80 (FIG. 6) at the forward end of a cylindrical high pressure housing 82, which is threaded into the rear end of a cylindrical sleeve 84, the forward end of which makes a snug fit in and is welded to the rear end of the pumping cylinder 32 (FIG. 4).

With the piston in contact with the check valve 80, a maximum amount of compressed air is forced through the check valve and into the high pressure housing. The pump is approximately at a "dead center", i.e., with the longitudinal axis of the piston rod substantially collinear with the pivot pins 44 and 62 secured to the web on the muzzle end of the gun barrel. At this point in the pumping cycle, the cylinder extends rearwardly away from the barrel at an angle of about 3°, leaving adequate clearance around the rear end of the cylinder to grip it with one hand and actuate the pump. Once the high pressure housing is sufficiently charged with compressed air, the cylinder is forced past the "dead center" position to be parallel with the barrel as shown in FIG. 1. The force required to move the cylinder past dead center is accommodated by the inherent elasticity in the assembled gun, and is sufficient to exert moderate detent action, which holds the pump cylinder against the barrel without any other support.

The forward end of the sleeve 84 includes an inwardly extending annular shoulder 86 disposed around a central bore 88, which receives a forwardly extending cylindrical boss 90 on the forward end of an inlet check valve housing 92 for the inlet end of the high pressure housing. An O-ring 94 seals the exterior of the boss 90 to the interior surface of bore 88. An O-ring 96 seals the main body of the check valve housing to the interior of the forward end of the high pressure housing. A check valve piston 98 with an O-ring 99 makes a sliding seal in a longitudinally extending central bore 100 in the check valve housing. Central bore 100 extends from the rear end of the check valve housing to a forwardly and inwardly tapering section 101 of the central bore, and continues as a small orifice 102 opening out the forward end of the check valve housing. A lateral bore 104 located to the rear of the check valve piston 98 extends through the check valve housing to connect the central bore 100 to a longitudinal slot 106 formed in the exterior of the check valve housing to provide communication through the check valve to the interior of the high pressure housing.

The forward end of a strong compression spring 108 bears against the rear face of a circular retaining cap 110 disposed over the rear end of central bore 100 of the check valve housing 92. A forwardly extending central boss 112 on the forward face of the retaining cap urges a small compression spring 114 against the rear face of the check valve piston to hold the check valve in the closed position shown in FIGS. 4 and 6.

The rear end of the large compression spring 108 bears against the forward end of a floating differential piston 116 disposed within the high pressure housing to define a high pressure storage chamber 117 between the floating piston and the check valve housing 92. A firing or discharge chamber 118 is formed in the high pressure housing between the rear end of the floating differential piston and the forward end of a cylindrical firing valve 119 housing sealed by an O-ring 120 in the rear end of the high pressure housing.

Figure 5:
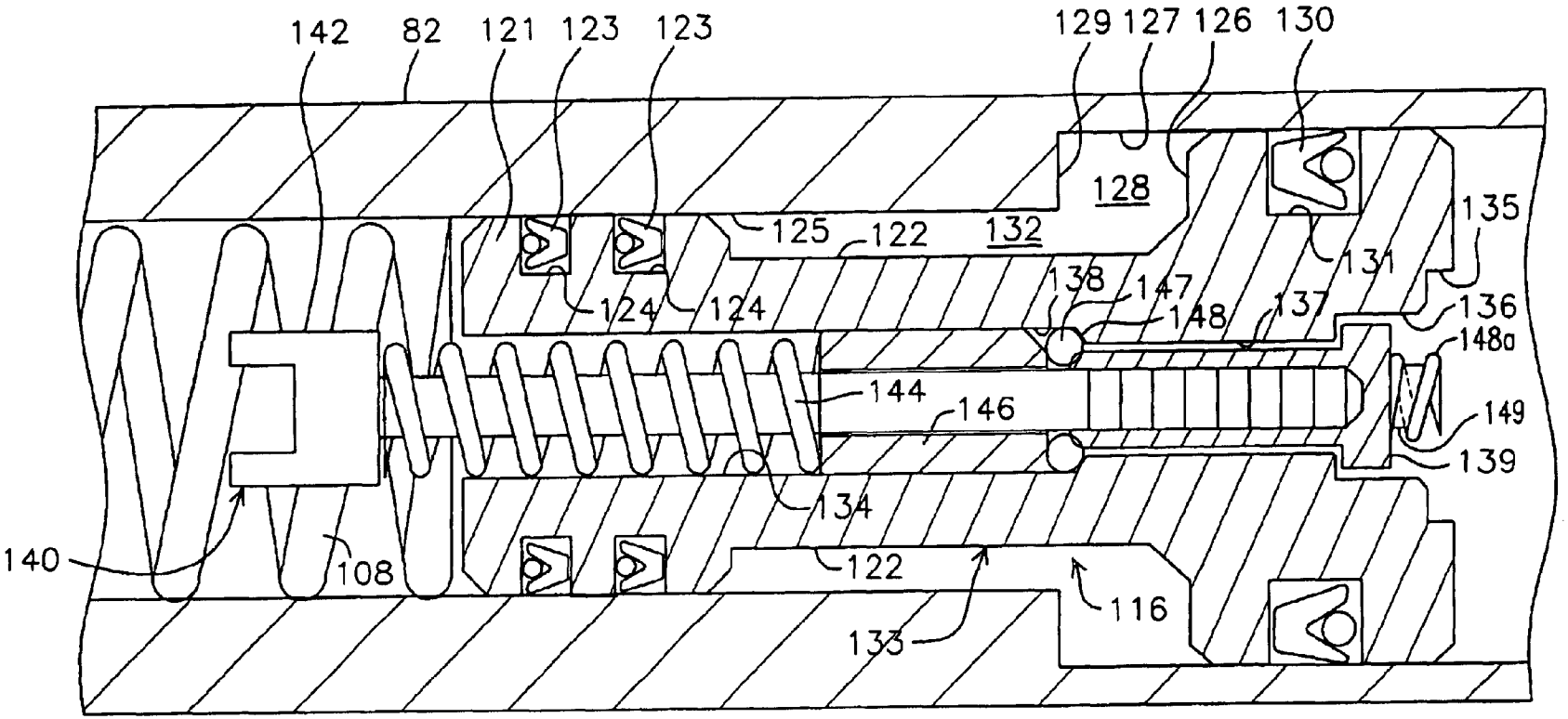
FIG. 5 is an enlarged fragmentary sectional view of the floating differential piston.
Figure 6:
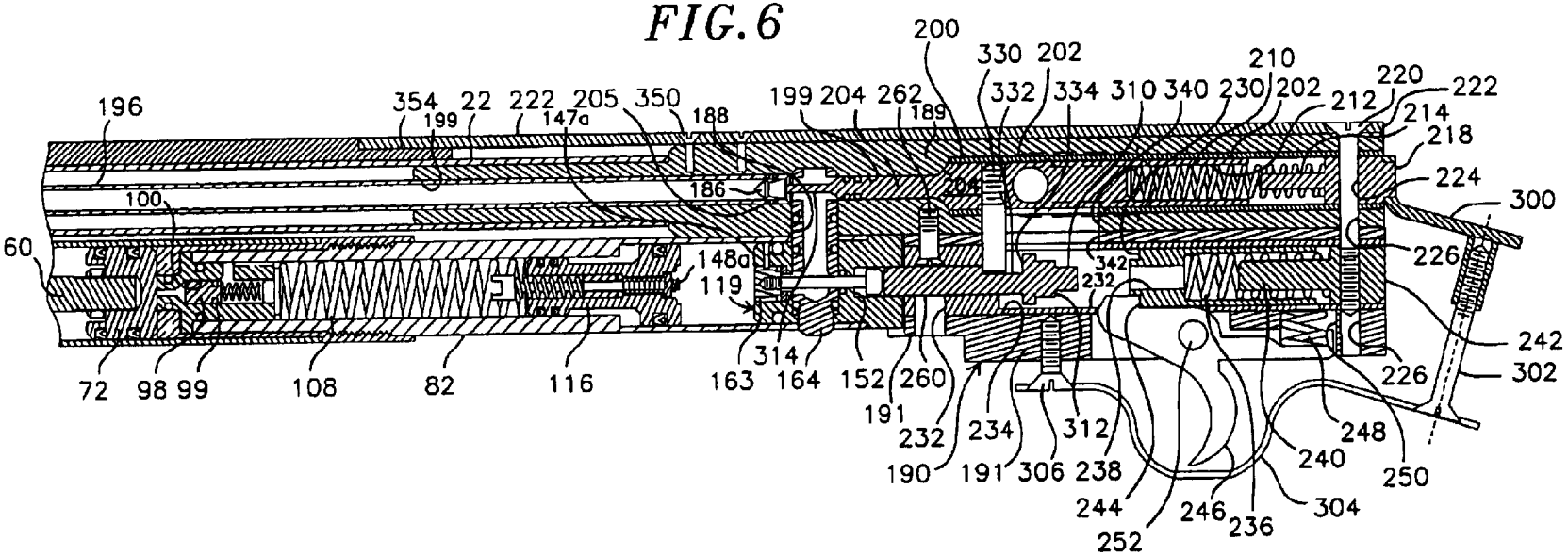
FIG. 6 is an enlarged longitudinal section of the breech end of the gun taken in the area of line 6—6 of FIG. 1.

As shown best in FIGS. 4, 5 and 6, the forward end of the floating differential piston includes an integral annular portion 121 which has an outer diameter slightly larger than that of an intermediate portion 122 of the floating piston, and makes a close sliding fit against the adjacent wall of the high pressure housing. A pair of longitudinally spaced U-cup piston seals 123 are each disposed in a separate respective outwardly opening annular groove 124 in the forward end 121 of the floating differential piston to make a sliding seal against the interior adjacent section 125 of the high pressure housing. The seals 123 are set to prevent air flow rearwardly past the floating differential piston.

The rear end 126 of the floating differential piston is of larger diameter than the forward end 121 of the piston, and makes a close sliding fit against the adjacent section 127 of the high pressure housing, which has a stepped bore 128 with an inwardly extending and rearwardly facing annular shoulder 129 to accommodate the different outer diameters of the ends of the floating piston. An annular U-cup piston seal 130 in an outwardly opening annular groove 131 around the rear end of the floating piston makes a sliding seal against the larger diameter interior section 127 of the high pressure housing. Thus, the cross-sectional area of the firing chamber sealed by the rear end of the floating differential piston is substantially greater than the cross-sectional area of the storage chamber sealed by the forward end of the piston, which provides a unique system for storing and discharging energy, as described below.

An annular space 132 between the intermediate portion 122 of the floating piston and the adjacent interior wall of the high pressure housing preferably is partially filled with a suitable lubricant, such as a light oil.

As shown best in FIG. 5, an adjustable pressure relief valve 133 is disposed in a stepped bore 134 extending longitudinally through the center of the floating differential piston. Starting at the rear end of the piston, the stepped bore 134 includes a first large section 135, which tapers inwardly and forwardly down to a second section 136, which steps down to a third section 137, which tapers outwardly and forwardly to a fourth section 138, which opens out of the front end of the floating piston.

An internally threaded valve cap 139 opens in a forward direction and receives the rear end of an adjustable externally threaded set screw 140 having a head 142 projecting forward of the floating differential piston and disposed within the rear end of the strong compression spring 108. A pressure relief compression spring 144 disposed around the shank of the set screw 140 bears at its forward end against the rear face of the set screw head 142, and at its rear end against the forward end of a cylindrical sleeve 146, which makes a loose fit around the set screw shank. Spring 144 urges sleeve 146 rearwardly so the rear end of the sleeve bears against an O-ring 147 in a forwardly and outwardly extending tapered section 148 between the third and fourth sections 137 and 138, respectively, of the stepped bore 134. The O-ring seals against the adjacent interior surface bore 134 and the forward end of the internally threaded valve cap 139 on the set screw. The setting of the set screw 140 within the valve cap 139 establishes the force the pressure relief spring 144 causes the forward end of the valve cap to exert against the O-ring 147. When the air pressure in the storage chamber at the front of the floating differential piston exceeds the air pressure in the firing chamber at the rear of the piston by an amount greater than the force set by the pressure relief valve spring 144, valve cap 139 is forced rearwardly so that it no longer seals against O-ring 147. This permits air to flow from the storage chamber into the firing chamber until the differential pressure between the two chambers equals the value set by the pressure relief spring 144. Ordinarily, the spring is set so that the pressure difference is several hundred pounds per square inch, say about 600 psi.

When the gun is first used, that is, before any pumping action, the strong spring 108 in the high pressure storage chamber urges the floating differential piston rearwardly until the piston engages the forward face of a cylindrical poppet 147*a* in the firing valve 119. A compression closure spring 148*a* (FIGS. 4,5 and 6) around a rearwardly extending boss 149 on the rear face of the valve cap 129 urges the poppet in the firing valve into the closed position as described below. Preferably, the strong spring 108 is preloaded, say with a force of about 30 pounds, when the gun is assembled. For example, referring to FIG. 4, when the forward end of high pressure housing 82 is threaded into the rear end of sleeve 84, the rear face of the floating differential piston is forced against the forward face of poppet 147*a*, causing the desired pre-loading to be imposed on the strong spring 108. This improves retention of compressed air in the storage chamber, thereby providing better overall performance of the gun.

Another advantage of the pump design shown in FIG. 4 is that it can be quickly disassembled, permitting easy access to the O-ring and U-cup seals used in the check valve, floating differential piston, and firing valve assembly. Unthreading the sleeve 84 from the forward end of the high pressure housing 82 causes the O-ring seal 96 on the check valve housing 90 to clear the high pressure storage chamber and release any pressure in that chamber. The pressure is safely relieved when a number of threads are still in contact, thus allowing air to be expelled safely. The pressure of any air in the firing chamber drops, say to about 75 psi, as the floating differential piston is pushed forward into the high pressure chamber. Firing the gun releases any remaining pressure in the firing chamber so the entire rear end of the assembly shown in FIG. 4 can be safely disassembled, using only a small allen wrench as described below.

As the pump is operated by swinging the cylinder away from and back toward the gun barrel, the first strokes, say 15 or 20, deliver compressed air only to the storage chamber until the pressure in the storage chamber reaches the value set by the pressure relief valve. Thereafter, further pumping opens the pressure relief valve to admit air into the firing chamber until the pressure in the firing chamber equals the pressure in the storage chamber, less the pressure set by the pressure relief valve. Continued pumping increases the pressure in both the storage chamber and the firing chamber until the force exerted on the rear end of the floating differential piston by the compressed air in the firing chamber exceeds the force exerted on the forward end of the piston by the compressed air in the storage chamber. The piston then slides forward to reduce pressure in the firing chamber and increase pressure in the storage chamber until the forces on each end of the piston are balanced. For example, if the area of the rear end of the floating piston is twice that of the forward end, and the pressure relief valve is set at 600 psi, the forward movement of the piston as just described begins when the pressure in the firing chamber is 600 psi, and the pressure in the storage chamber is 1200 psi. Further pumping increases the pressure in both chambers, causing the piston to move forward to adjust the relative volumes of the storage and firing chambers so the pressure in the storage chamber is twice that in the firing chamber. The forward movement of the piston continues with additional pumping until the forward end of the piston engages the internal shoulder 129 in the high pressure housing. The strong spring 108 is now compressed, and ready to act with the compressed air in the storage chamber to drive the piston forward as described below when the gun is fired. Pumping can be discontinued before the floating differential piston is forced to the full forward position, i.e., with the forward end of the piston engaging the internal shoulder 129, and the gun can be fired with reduced power. For example, FIG. 1 shows the gun in firing position with the air pressure in the firing chamber only high enough to force the floating differential piston through only about 75% of the full travel possible.

Flow of compressed air through the pressure relief valve is fairly restricted because of the close fit of sleeve 146 in bore section 138 and around the shank of set screw 140. The flow path is adequate for charging the firing chamber with compressed air, but sufficiently restrictive to prevent excessive loss of compressed air when the gun is fired. This is important because minimum loss of air from the storage chamber when the gun is fired permits the storage and firing chambers to be recharged for the next is shot with relatively few, say seven to ten, strokes of the pump.

Figure 5A:
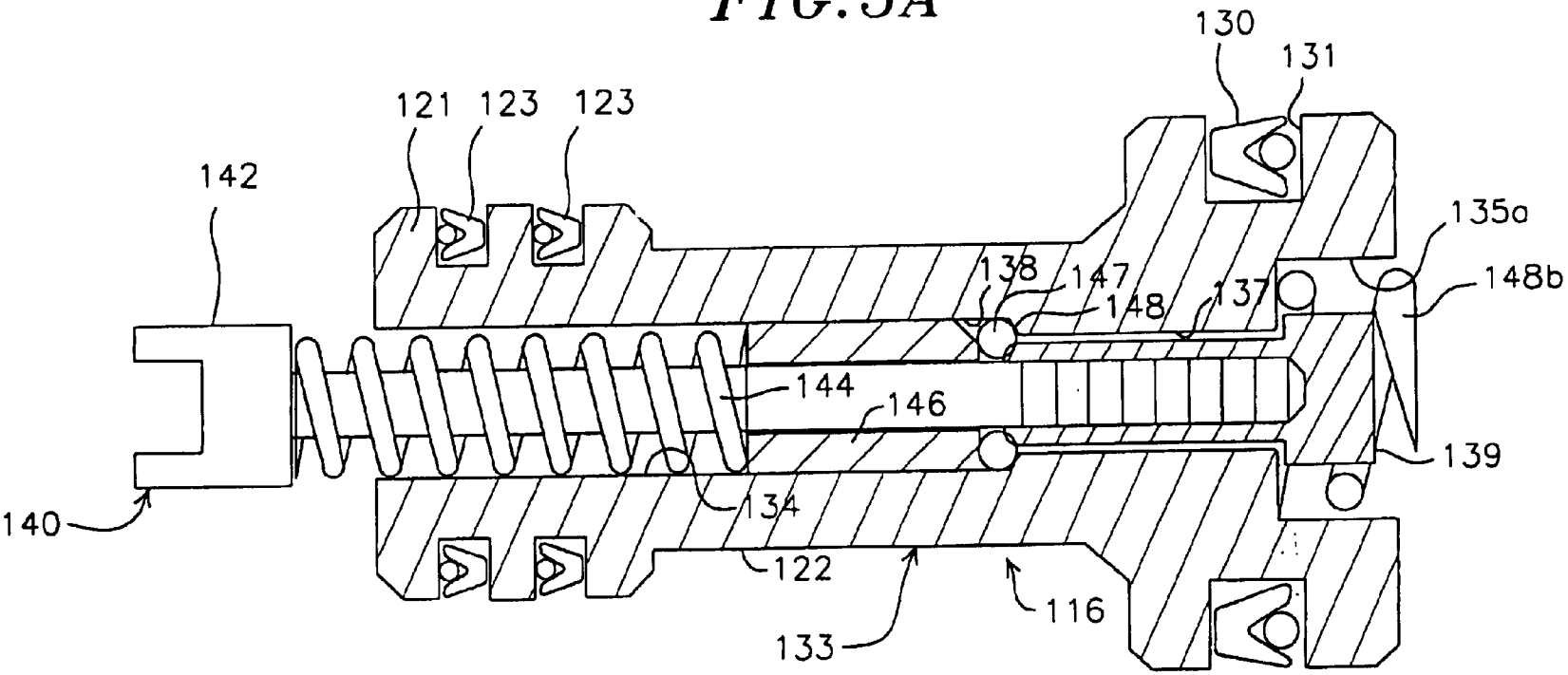
FIG. 5A is a fragmentary view similar to that of FIG. 5 showing an alternate embodiment of the floating differential piston.

FIG. 5A shows an alternate, and preferred, embodiment of the floating differential piston 116. The embodiment shown in FIG. 5A is almost identical with that shown in FIG. 5, and the same reference numerals are used in FIG. 5A to identify identical elements in FIG. 5. The difference between the two embodiments is that in the one shown in FIG. 5A, the rear end of stepped bore 134 includes a first large section 135*a*, which is substantially deeper than the first large section 135 of FIG. 5. The deeper first large section 135*a* of FIG. 5A replaces the second section 136 of FIG. 5 to accommodate a compression closure spring 148*b*, which makes a loose fit around the rear end of valve cap 139, and a close fit within deep bore 135*a*. The rear end of compression spring 148*b* engages the forward face of the poppet 147*a* when the gun is fired and the floating differential piston is driven to the rearmost position. Since compression spring 148*b* does not exert any force on the valve cap 139, the spring can be stiff, and therefore exert a large force on the poppet 147*a* without influencing the setting of the pressure release valve 133. Moreover, the large force exerted by compression spring 148*b* permits the use of hard rubber as the material for the annular washer 156 against which poppet 147*a* seats. This arrangement causes the poppet to open the firing valve quickly when the gun is fired, and thus improves the efficiency of the firing operation. Preferably, compression spring 148*b* causes the poppet 147*a* to close the firing valve 119 before the rear face of the floating piston contacts the forward face of the firing valve. This retains a small amount of high pressure firing air in the firing chamber, say at a pressure between about 500 and about 800 psi, and therefore retains more compressed air in the high pressure storage chamber. This decreases the number of pump strokes required for subsequent charging for the next firing cycle.

To prevent possible damage to the gun or seals in the gun due to over pumping, the pump piston can be provided with a pump piston pressure relief valve, such as that shown in U.S. Pat. No. 5,617,837 to Momirov.

The firing valve 119 at the rear end of the high pressure housing includes a longitudinal firing pin 150 disposed in a longitudinal stepped bore 152 extending through the firing valve. The forward end of the firing pin is threaded into the cylindrical poppet 147*a*, the rear face of which seats on an annular washer 156 of hard rubber on a forwardly facing shoulder 158 in the stepped bore. The forward face of the poppet 147*a* is contacted by the rear end of closure spring 148*a* or 148*b* (FIGS. 5 and 5A) on the rear face of the pressure relief valve 133 in the floating differential piston when the piston is urged against the forward face of firing valve 119 by the strong compression spring 108 and the compressed air in the storage chamber, as described above. The poppet 147*a* is prevented from rotating relative to the firing valve housing by a stop pin 160 press fitted in a lateral bore 162 extending through a forward portion of the firing valve housing. The inner end of stop pin 160 fits loosely in one of four identical longitudinally extending and outwardly opening grooves 163 (only two grooves are shown in FIGS. 4 and 6) spaced at equal intervals around the poppet. The rear end of the firing pin carries an allen head 161, which permits the firing pin to be removed from poppet 147*a* (after all compressed air is released from the high pressure housing as described above) so the firing valve can be disassembled with an allen wrench for servicing.

The firing valve housing 119 is secured in the rear end of the high pressure housing by a transverse retaining pin 164, which extends down through a pair of collinear bores 166 through the rear end of the high pressure housing, and through transverse stepped bore 167 through the firing pin housing. An oversize bore 168 extending longitudinally through the forward side of a lower portion of the retaining pin receives the shank of the firing pin 150, which makes a close sliding fit through a bore 170 extending through the rear side of the retaining pin. An O-ring seal 172 makes a sliding seal around the firing pin shank and a section 173 of stepped bore 152 extending through the firing valve housing. The retaining pin 164 is locked against transverse movement with respect to the high pressure housing by the firing pin extending through bore sections 170 and 173. An O-ring 174 around a lower portion of the retaining pin seals that part of the pin against the firing valve housing. O-ring 176 around an upper portion of the retaining pin seals that portion of the pin against the adjacent portion of the firing valve housing. A cylindrical recess 180 in the retaining pin extends down from the upper end of the retaining pin to just below longitudinal bores 168 and 170 in the retaining pin to form a firing conduit 181 for transferring compressed air from the firing chamber to the breech of the gun, as described in detail below. The upper end of the recess 180 is sealed by an elastomeric plug 182. A longitudinally extending pellet bore 184 through the upper end of the retaining pin traverses the firing conduit 181, and receives a pellet or projectile 186, which is held in the bore 184 by friction contact with elastomeric plug 182 and the surrounding surface of bore 184.

Figure 9:
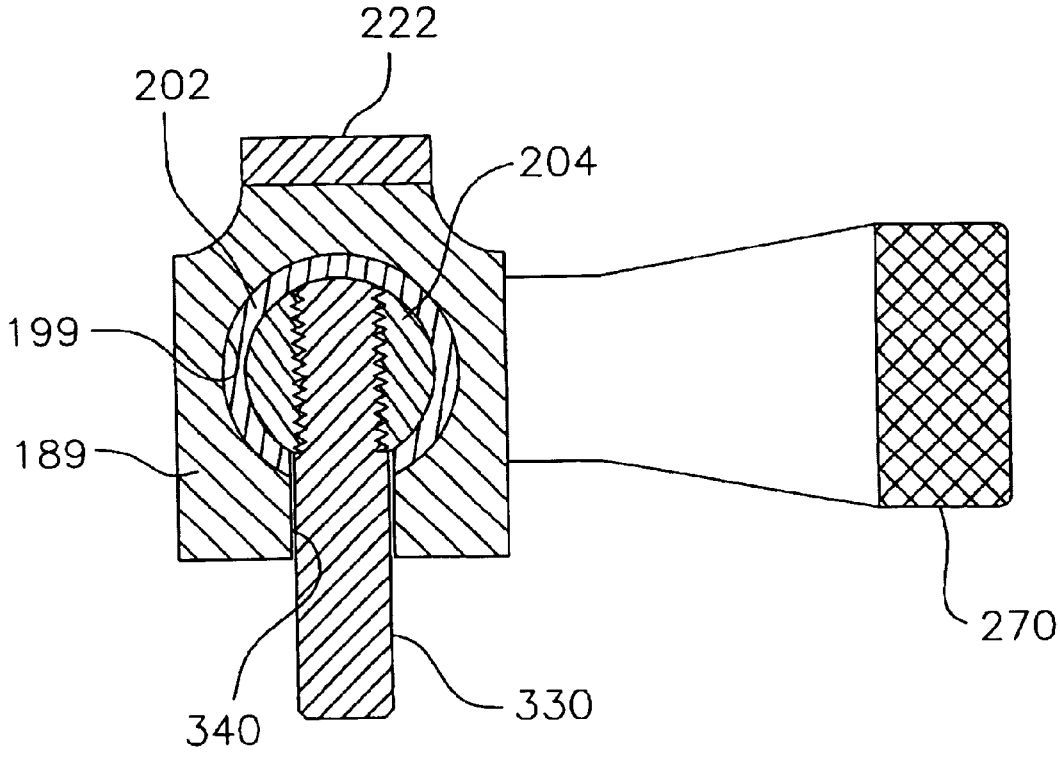
FIG. 9 is a view taken on line 9—9 of FIG. 7.
Figure 10:
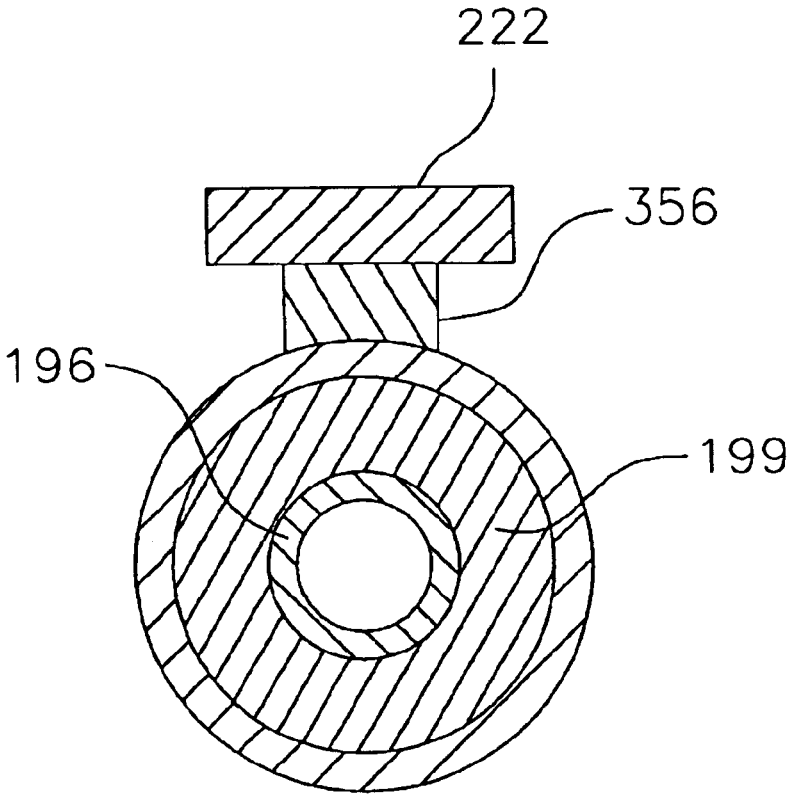
FIG. 10 is a view taken on line 10—10 of FIG. 2.

When the pumping cylinder and high pressure housing are moved up to the firing position shown in FIGS. 1 and 6, the upper end of the retaining pin 164 nests in a downwardly opening cylindrical recess 188 (FIG. 2) in an upper block 189 of a breech assembly 190 (which includes a lower block 191 secured to the upper block as described below) so that the pellet 186 is in longitudinal alignment with the breech end 194 (FIG. 2) of an elongated rifled barrel 196 coaxially mounted in the steel outer barrel 22. The upper surface of the elastomeric plug 182 bears against the inner end of recess 188 in the upper block. The breech end of the rifled barrel makes a snug fit in the forward end of an elongated longitudinally extending bore 199 extending through the upper block (FIGS. 6 and 9.)

Figure 4E:
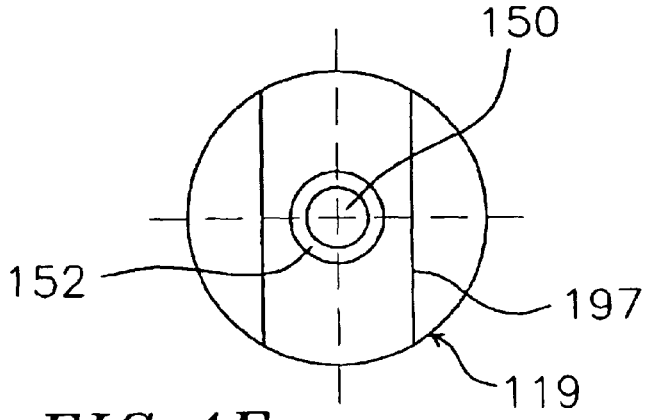
FIG. 4E is a view taken on line 4E—4E of FIG. 4.
Figure 4F:
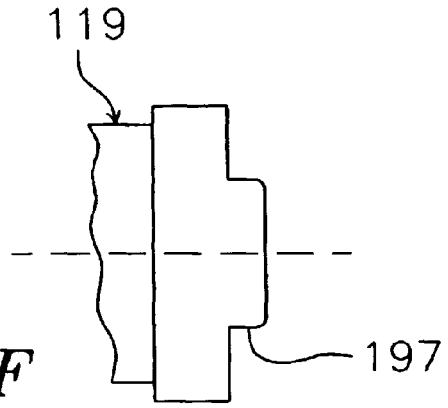
FIG. 4F is a fragmentary view taken on line 4F—4F of FIG. 4.

As shown in FIGS. 4, 4E and 4F, the rear end of the firing valve housing includes a rearwardly extending vertical tang 197, which makes a snug sliding fit in a vertical slot 198 (FIG. 2) in the forward end of the lower breech block 191. The upper end of tang 197 on the rear end of the firing valve assembly tapers upwardly and forwardly at an angle of about 5° from vertical to facilitate the movement of the tang into and out of the vertical slot 198 in the forward end of the lower breech block. An O-ring 192 around retaining pin 164, just below pellet bore 184, facilitates the pin making a releasable sealed fit into the downwardly opening recess 188 in the upper breech block 189.

The rear portion of bore 199 in the upper breech block includes an outwardly and rearwardly tapered section 200, which connects to a longitudinal extension of bore 199 to hold a cylindrical bronze bearing sleeve 202 in which a cylindrical bolt 204 is mounted to slide back and forth to drive the pellet into the breech end of the rifled barrel as shown in FIG. 6. A pair of longitudinally spaced O-rings 205 around the rear end of the rifled barrel seal the barrel against the interior of bore 199 in the upper breech block.

Figure 6A:
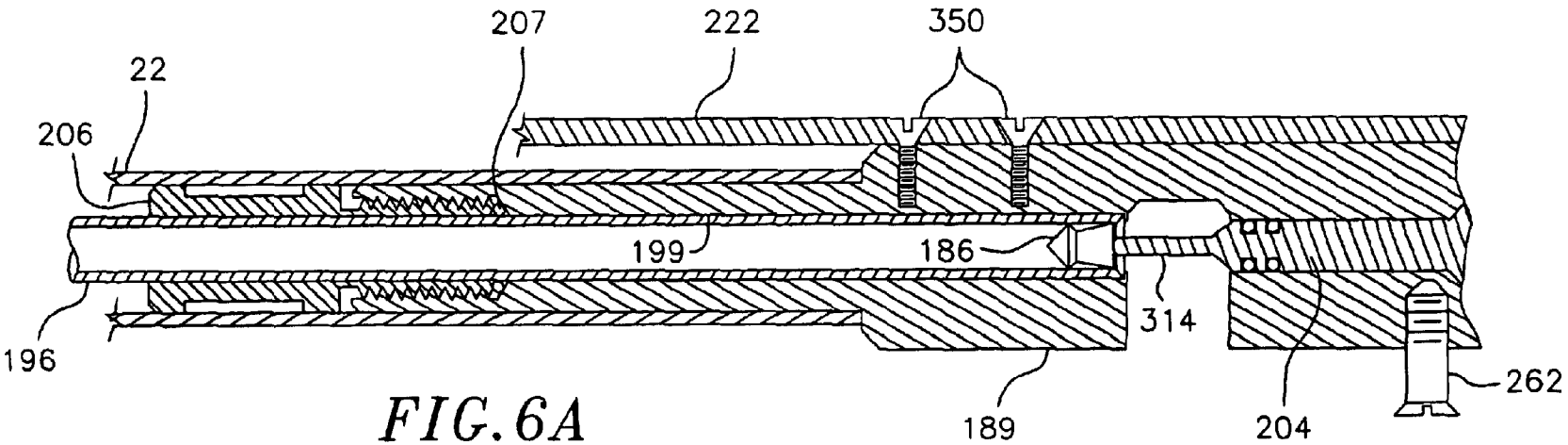
FIG. 6A is a fragmentary view similar to FIG. 6 showing an alternate embodiment for mounting the breech end of the barrel in the gun.

FIG. 6A shows an alternate embodiment for sealing the breech end of the rifled barrel 196 in bore 199 in the forward end of upper breech block 189. The rear end of a cylindrical plug 206 is threaded into the forward end of bore 199 to compress an O-ring 207 against the exterior of rifled barrel 196 and the interior of bore 199.

A bolt compression spring 210 in a rearwardly opening longitudinal cylindrical recess 212 in the bolt urges the bolt toward the forward or firing position shown in FIG. 6. The rear end of the bolt compression spring fits over a forwardly extending guide 214 formed integrally at its rear end with a rear retaining fitting 218, which is held in place by a rear vertical screw 220 extending down through a barrel upper guide and scope mount 222, the upper block 189, the bronze sleeve 202, a vertical bore 224 in the rear retaining fitting 218, and a pair of vertically spaced collinear bores 226 in the lower block 191.

A longitudinally extending cylindrical hammer 230 makes a sliding fit within a cylindrical bronze firing piston sleeve 232 press fitted into a longitudinal bore 234 extending through the lower block. A compression firing spring 236 in a longitudinal stepped bore 238 extending through the hammer 230 fits around a longitudinal and forwardly extending cylindrical guide 240 formed integrally with a rear retaining fitting 242 held in the rear end of the bronze firing piston sleeve by vertical screw 220. The firing compression spring is held in a compressed condition by a pawl 244 engaging the forward end of the hammer. The pawl is on a trigger 246 mounted in a lower portion of the lower breech block. A compression trigger spring 248 in a downwardly opening recess 250 in the lower block urges the trigger in a clockwise (as viewed in FIG. 6) direction around a trigger pivot 252 so the hammer holds the firing spring in the compressed condition. When the trigger is pulled, the hammer is released so the compression spring drives the hammer forward to strike and drive forward a firing piston 260, which drives the firing pin and poppet forward to open the firing valve and release compressed air from the firing chamber through the firing conduit 181 and into the breech end of the rifle barrel to drive the pellet forward.

A forward vertical retaining screw 262 secures the bronze firing piston sleeve within the lower block, and secures the forward portion of the lower block to the upper block, which projects a substantial distance forward of the lower block.

Figure 7:
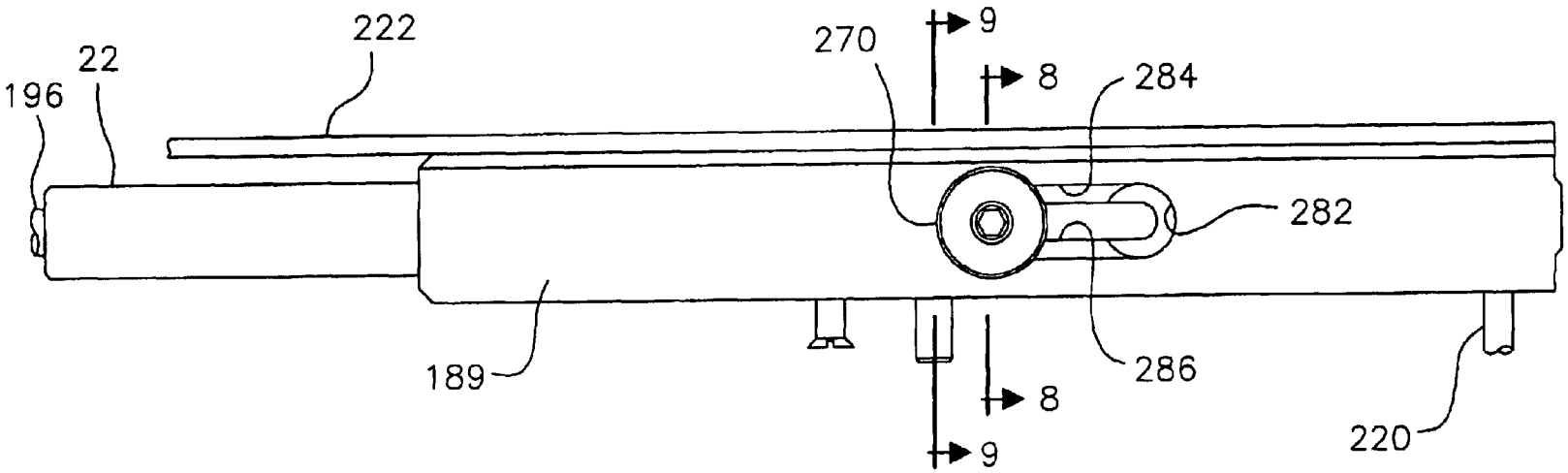
FIG. 7 is a fragmentary elevation of the left (as when sighting down the barrel of the gun) side of the breech end of the gun.
Figure 8:
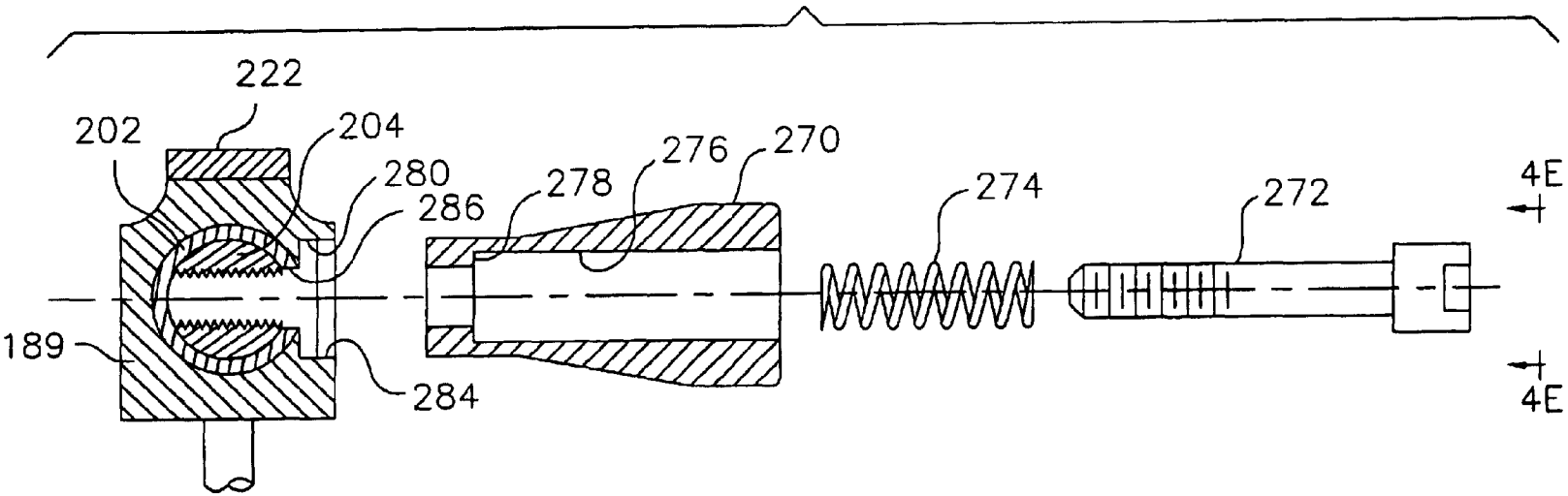
FIG. 8 is a view taken on line 8—8 of FIG. 7.

Once the gun is fired, the bolt is returned to the loading position shown in FIG. 2 by operation of a bolt handle 270 (FIGS. 7, 8 and 9), which is secured to the bolt 204 by a screw 272 which extends through a compression spring 274 mounted in a stepped bore 276 in the bolt handle 270. The inner end of the screw 272 is threaded into the bolt. The head of the screw 272 bears against the outer end of compression spring 274, the inner end of which bears against an internal shoulder 278 in the bolt handle. The inner end of the bolt handle is cylindrical and shaped to fit in either a forward or firing detent bore 280 or in a rear or loading and safety detent bore 282 formed in the left (as when sighting down the barrel of the gun) side of the upper block housing of the breech assembly. The two detent bores are connected by a longitudinal slot 284 in the upper block and a slot 286 in the bronze sleeve 202.

The forward detent bore 280 holds the bolt in place against back pressure when the gun is fired. The rear detent bore holds the bolt in the rear position shown in FIG. 2 so the gun can be loaded, but not fired, as explained below. A pair of longitudinally spaced O-rings 205 around the bolt at its forward end make a sliding seal between the bolt and the longitudinal bore in the upper block of the breech assembly. Another pair of longitudinally spaced O-rings 205 around the rear end of the rifled barrel seal that portion of the barrel against the longitudinal bore extending through the upper block of the base assembly. A gun stock (not shown, and which may be conventional) is secured to the breach assembly by a hold-down bracket 300 welded to the rear of fitting 218, and by a stock screw 302, which also secures the rear end of a trigger guard 304 to the stock. The forward end of the trigger guard is secured to the stock and the underside of the lower block of the breech assembly by a screw 306.

When the gun is fired the hammer compression spring 236 drives the hammer forward so the longitudinal bore 238 in the hammer slides over a rearwardly extending cylindrical boss 310 on the rear end of the firing piston until the forward end of the hammer slams into a rearwardly facing annular shoulder 312 surrounding the projection 310. The firing piston then drives the firing pin forward to force the firing valve open and released compressed air from the firing chamber into the breech end of the rifled barrel behind the projectile. As shown in FIG. 6, the forward end of the bolt 204 includes a section 314 of reduced diameter to permit compressed air to flow freely around the bolt and into the breech end of the rifled barrel.

As also shown in FIG. 6, before the gun is fired, the forward end of the firing piston 260 extends forward of the front face of the firing piston sleeve 232 and the forward end of the lower block 191 into the rearwardly opening bore 152 in the rear face of the firing valve housing so the forward end of the firing piston bears against the rear end of the firing pin, and also locks the pumping cylinder and high pressure housing in the firing position shown in FIGS. 1 and 6.

To prepare the gun for another firing, the bolt handle 270 (FIGS. 7 and 8) is pulled out slightly away from the breech assembly so the inner end of the bolt handle clears the forward (firing) detent bore 280. The bolt handle and bolt screw 272 are free to slide rearwardly through slot 284 in the breech assembly upper block and slot 286 in the bronze bearing sleeve 202. A vertical cocking pin 330 (FIG. 6) is threaded at its upper end into the bolt just forward of the bolt handle. The lower end of the cocking pin extends down into an upwardly opening longitudinal slot 332 in the upper surface of the firing piston 260. When the gun is in the firing position, the lower end of the cocking pin is at the forward end of slot 332, which is long enough to permit the firing piston to move forward and open the firing valve when the gun is fired. When the bolt handle is pulled out and the bolt slid to the rear position so that bolt handle can snap into the rear detent bore 282, the lower end of the cocking pin travels rearwardly through slot 332 until it engages a forwardly facing shoulder 334 at the rear end of the slot. Thereafter, the cocking pin pushes the firing piston and hammer rearwardly to the position shown in FIG. 2, compressing hammer spring 236 to the condition shown in FIG. 6. The trigger spring 248 forces the trigger to rotate in a clockwise direction around the trigger pin 252 so the trigger pawl locks the hammer in the cocked position. With the firing piston retracted to the position shown in FIG. 2, and the bolt locked in the rear (safety) detent, the firing valve housing and pumping cylinder are free to swing away from the gun barrel, as shown in FIG. 2, and a pellet can be inserted into bore 184 of retaining pin 164 (FIG. 4). Moreover, with the bolt locked in the rear detent, the locking pin 330 locks the firing piston 260 in the rear position shown in FIG. 2 so the hammer cannot be driven forward by compression spring 236, even if the trigger is pulled. Thus, the gun is locked in a "safety" condition.

Once the firing chamber is recharged with compressed air as described above, and a pellet is inserted in the pellet chamber as shown in FIG. 2, the pump and high pressure housing is returned to the position shown in FIG. 1. The bolt handle can then be pulled outwardly from the rear detent, and slid forward to the forward detent so the forward end of the bolt pushes the pellet into the breech end of the rifle barrel, and the cocking pin pushes the firing piston forward to the locking position shown in FIGS. 2 and 6. A downwardly opening and longitudinally extending slot 340 (FIGS. 6 and 9) in the upper block, and an upwardly opening and longitudinally extending slot 342 in the upper surface of the lower block permits the cocking pin to slide back and forth as just described.

An intermediate portion of the rear barrel stiffener 222 is secured to the top surface of the upper block 189 by a pair of longitudinally spaced screws 350. The forward end of the rear barrel stiffener 222 rests in a rearwardly opening notch 354 of an elongated and longitudinally extending forward barrel stiffener 356 welded to the top of the outer barrel 22. The rear and forward barrel stiffeners provide the stiffness required because of the large mechanical advantage developed by the pump linkage.

Figure 11:
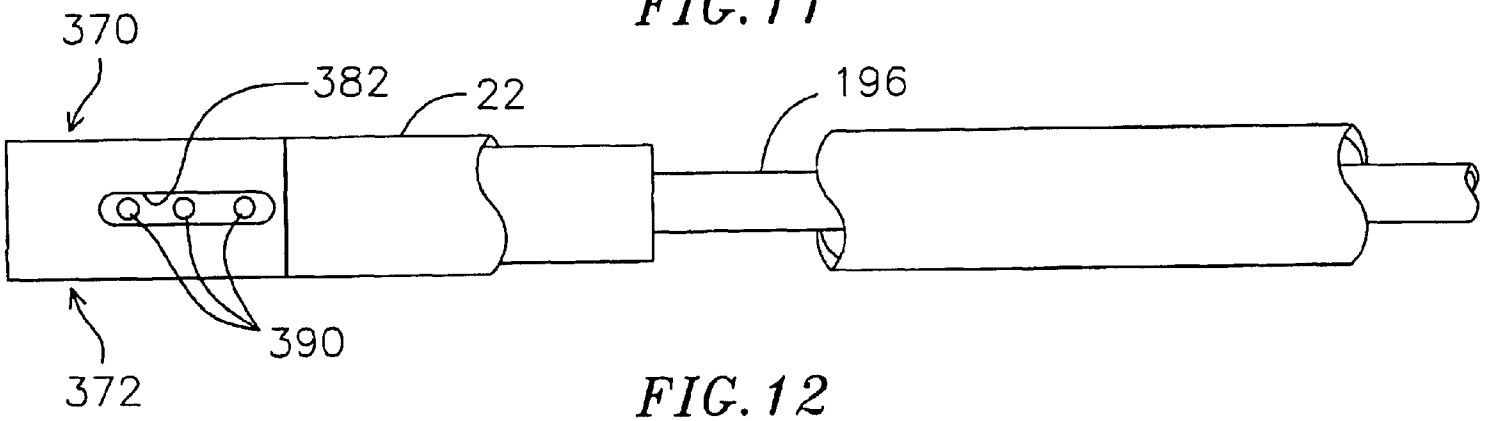
FIG. 11 is a fragmentary view, partly broken away, taken on line 11—11 of FIG. 2.
Figure 12:
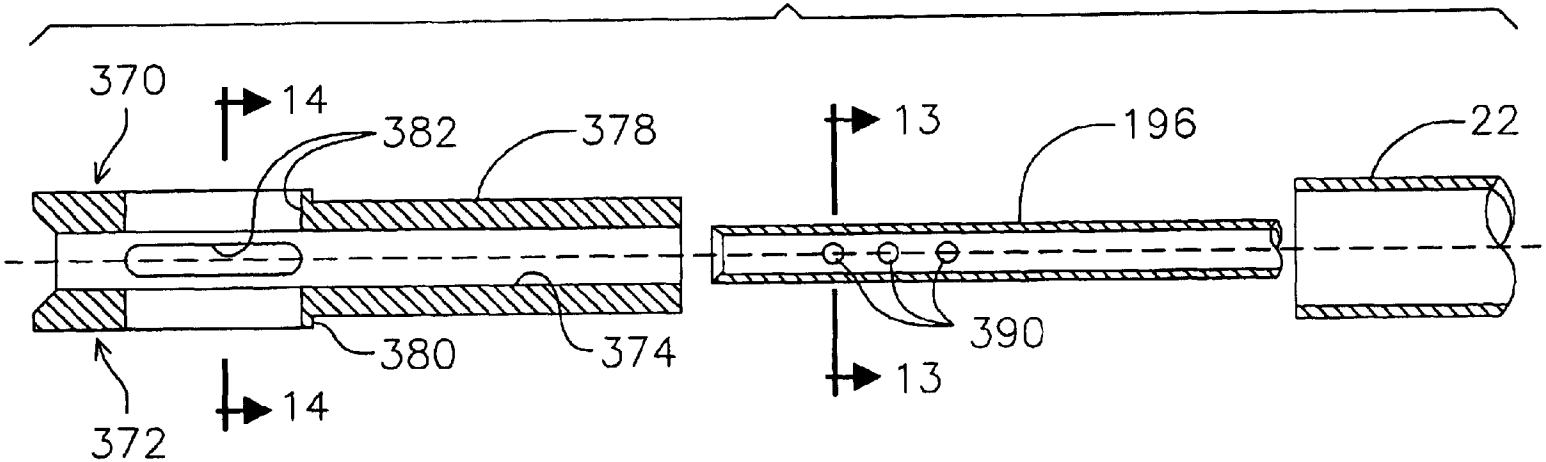
FIG. 12 is an exploded view, in longitudinal section, of the elements shown in FIG. 11.
Figure 13:
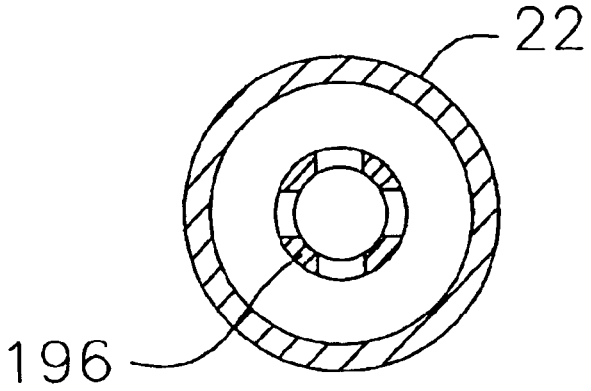
FIG. 13 is a view taken on line 13—13 of FIG. 12.
Figure 14:
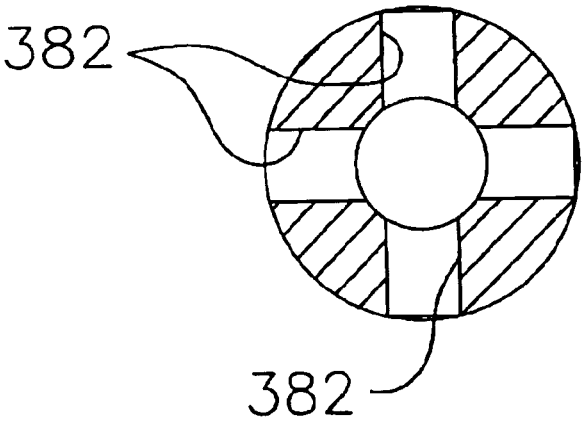
FIG. 14 is a view taken on line 14—14 of FIG. 12.

Referring to FIGS. 11–14, a pressure relief fitting 370 includes an elongated and longitudinally extending cylindrical body 372 which has a uniform longitudinal cylindrical bore 374 extending through it and making a snug sliding fit over the muzzle end of the rifled barrel 196. As shown in FIG. 2, the forward ends of the rifled barrel and the pressure relief fitting are substantially coterminous, and each are tapered forwardly and outwardly. The pressure relief fitting is welded to the rifled barrel in the position shown in FIGS. 2 and 11. The forward end of the steel outer barrel 22 makes a snug sliding fit over the rear end of the pressure relief fitting, which includes a section 378 of reduced external diameter to receive the outer barrel, the forward end of which abuts against a rearwardly facing annular shoulder 380 at the forward end of section 378. The steel outer barrel is welded to the pressure relief fitting. The forward end of the pressure relief fitting has four elongated and longitudinally extending slots 382, which open radially outwardly through the pressure relief fitting with equal angles between adjacent slots. Four sets of three longitudinally spaced and circular vents 390 extend radially through the forward end of the rifled barrel so that each set of three vents is centered within a respective slot 382, as shown in FIGS. 2 and 11.

The pressure relief fitting and rifled barrel vents improve the accuracy of the gun because the force of the discharged air behind the pellet is so great that if the venting and pressure relief were not provided, the compressed air emerging from the muzzle of the gun would tend to overrun the pellet and cause it to wobble or tumble. With the venting just described, some of the compressed air behind the pellet is released laterally from the muzzle as the pellet leaves the gun, thereby avoiding the pellet being overrun with the charge of compressed air. The longitudinally spaced vents 390 provide progressive venting of the compressed gas behind the pellet so that venting can take place rapidly, yet not prematurely, which would decrease the kinetic energy imparted to the pellet.

With the embodiment of the invention just described, a shooter of ordinary strength can easily operate the pump to charge the firing chamber with sufficient compressed air to impart a force of more than 40 foot-pounds to the pellet. This is sufficient to give a 22 caliber pellet weighing 25 grains a muzzle velocity of more than 850 feet per second.

I claim:

1. A pump comprising:

a cylinder having an inlet and an outlet;

a pumping piston mounted to reciprocate in the cylinder;

a piston rod secured at one end to the piston and at the other end to a first pivot point on a support;

an elongated drive link secured at one end to a pivot point on the cylinder and at the other end to a second pivot point on the support, so that as the cylinder and piston are moved back and forth about the first and second pivot points, the piston reciprocates in the cylinder;

a high pressure housing having an inlet and an outlet, the high pressure housing inlet being connected to the outlet of the pump cylinder;

a check valve between the pump cylinder outlet and the high pressure housing inlet; and a discharge valve in the high pressure housing outlet.

* * * * *